United States Patent [19]

Vervacke et al.

[11] Patent Number: 4,675,707

[45] Date of Patent: Jun. 23, 1987

[54] THERMALLY-RESPONSIVE RECORD MATERIAL

[75] Inventors: Steven L. Vervacke; Thomas C. Petersen, both of Appleton, Wis.

[73] Assignee: Appleton Papers Inc., Appleton, Wis.

[21] Appl. No.: 803,177

[22] Filed: Dec. 2, 1985

[51] Int. Cl.[4] ..... B41M 5/18

[52] U.S. Cl. ..... 503/214; 503/216; 503/217; 503/221; 503/225; 427/150; 427/151

[58] Field of Search ..... 346/216, 225, 214, 217, 346/218, 220, 221, 225; 427/150–152

[56] References Cited

FOREIGN PATENT DOCUMENTS

| | | | |
|---|---|---|---|
| 0056281 | 7/1982 | European Pat. Off. | 346/225 |
| 0090984 | 5/1983 | Japan | 346/225 |
| 0125695 | 7/1985 | Japan | 346/216 |
| 0228189 | 11/1985 | Japan | 346/216 |

*Primary Examiner*—Bruce H. Hess

*Attorney, Agent, or Firm*—E. Frank McKinney; Paul S. Phillips, Jr.

[57] ABSTRACT

A thermally-sensitive color-forming composition is disclosed which comprises chromogenic material and certain acidic developer material. Record material comprising this color-forming composition exhibits greatly improved background coloration.

15 Claims, No Drawings

THERMALLY-RESPONSIVE RECORD MATERIAL

This invention relates to thermally-responsive record material. It more particularly relates to such record material in the form of sheets coated with color-forming systems comprising chromogenic material and acidic color developer material. This invention particularly concerns a thermally-responsive record material with improved background properties.

Thermally-responsive record material systems are well known in the art and are described in many patents, for example U.S. Pat. Nos. 3,539,375; 3,674,535; 3,746,675; 4,151,748; 4,181,771; and 4,246,318 which are hereby incorporated by reference. In these systems, basic chromogenic material and acidic color developer material are contained in a coating on a substrate which, when heated to a suitable temperature, melts or softens to permit said materials to react, thereby producing a colored mark.

In the field of thermally-responsive record material, thermal sensitivity (response) is defined as the temperature at which a thermally-responsive record material produces a colored image of satisfactory intensity (density). Background is defined as the amount of coloration of a thermally-responsive record material before imaging and/or in the unimaged areas of an imaged material. The ability to maintain the thermal sensitivity of a thermally-responsive record material while reducing the background coloration is a much sought after and very valuable feature.

One of the uses for thermally-responsive record material which is enjoying increasing importance is fascimile reproduction. Alternative terms for facsimile are telecopying and remote copying. In the facsimile system, images transmitted electronically are reproduced as hard copy. One of the important requirements for thermally-responsive record material to be used in fascimile equipment is that it have good (low coloration) background properties.

Increases in the sensitivity of thermally-responsive record material have been achieved through the incorporation of a phenylhydroxynaphthoate compound or a hydroxyanilide compound in the color-forming composition along with the chromogenic material and developer material as disclosed in U.S. Pat. No. 4,470,057 or U.S. Pat. No. 4,535,347, respectively, by Kenneth D. Glanz. Such sensitizer materials can be advantageously used in combination with the present invention.

Applicant has discovered, unexpectedly, that a thermally-responsive record material employing a color-forming composition comprising chromogenic material and, as a color developer, a bisphenol compound of the structure

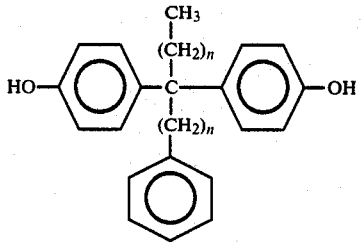

wherein n is 0, 1 or 2, produces a very satisfactory thermal sensitivity and much improved background coloration characteristics.

It is an object of the present invention to provide a thermally-responsive recording material having improved background properties.

It is likewise an object of the present invention to provide a thermally-responsive record material comprising a support member bearing a thermally-sensitive color-forming composition comprising chromogenic material and, as developer material, a bisphenol compound of the structure

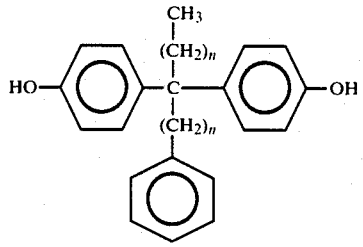

wherein n is as previously defined, in contiguous relationship, whereby the melting, softening, or sublimation of either material produces a change in color by reaction between the two, and a suitable binder therefor.

In accordance with the present invention, it has been found that these and other objectives may be attained by employing a thermally-sensitive color-forming composition comprising chromogenic material, acidic developer material comprising a bisphenol compound of the structure

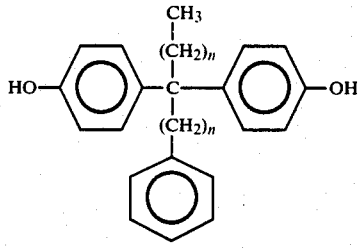

wherein n is 0, 1 or 2, and binder material.

The color-forming composition (or system) of the record material of this invention comprises chromogenic material in a substantially colorless state and acidic developer material. The color-forming system relies upon melting, softening, or subliming of one or more of the components to achieve reactive, color-producing contact.

The record material includes a substrate or support material which is generally in sheet form. For purposes of this invention, sheets also mean webs, ribbons, tapes, belts, films, cards and the like. Sheets denote articles having two large surface dimensions and a comparatively small thickness dimension. The substrate or support material can be opaque, transparent or translucent and could, itself, be colored or not. The material can be fibrous including, for example, paper and filamentous synthetic materials. It can be a film including, for example, cellophane and synthetic polymeric sheets cast, extruded, or otherwise formed. The gist of this invention resides in the color-forming composition coated on the substrate. The kind or type of substrate material is not critical.

Although not required to practice and demonstrate the beneficial properties of the claimed invention, the inclusion of certain sensitizing materials in the color-forming system provides a further improvement in properties, especially increases in sensitivity. Materials such as phenyl-1-hydroxy-2-naphthoate, stearamide and p-hydroxyoctadecananilide are useful as such sensitizing materials.

The components of the color-forming system are in a contiguous relationship, substantially homogeneously distributed throughout the color-forming system, preferably in the form of a coated layer deposited on the substrate. In manufacturing the record material, a coating composition is prepared which includes a fine dispersion of the components of the color-forming system, polymeric binder material, surface active agents and other additives in an aqueous coating medium. The composition can additionally contain inert pigments, such as clay, talc, aluminum hydroxide, calcined kaolin clay and calcium carbonate; synthetic pigments, such as urea-formaldehyde resin pigments; natural waxes such as carnauba wax; synthetic waxes; lubricants such as zinc stearate; wetting agents and defoamers.

The color-forming system components are substantially insoluble in the dispersion vehicle (preferably water) and are ground to an individual average particle size of between about 1 micron to about 10 microns, preferably about 1 to about 3 microns. The polymeric binder material is substantially vehicle soluble, although latexes are also eligible in some instances. Preferred water-soluble binders include polyvinyl alcohol, hydroxy ethylcellulose, methylcellulose, hydroxypropylmethylcellulose, starch, modified starches, gelatin and the like. Eligible latex materials include polyacrylates, polyvinylacetates, polystyrene, and the like. The polymeric binder is used to protect the coated materials from brushing and handling forces occasioned by storage and use of the thermal sheets. Binder should be present in an amount to afford such protection and in an amount less than will interfere with achieving reactive contact between color-forming reactive materials.

Coating weights can effectively be about 3 to about 9 grams per square meter (gsm) and preferably about 5 to about 6 gsm. The practical amount of color-forming materials is controlled by economic considerations, functional parameters and desired handling characteristics of the coated sheets.

Eligible chromogenic compounds, such as the phthalide, leucauramine and fluoran compounds, for use in the color-forming system, are well known color-forming compounds. Examples of the compounds include Crystal Violet Lactone [3,3-bis(4-dimethylaminophenyl)-6-dimethylaminophthalide (U.S. Pat. No. Re. 23,024)]; phenyl-, indol-, pyrrol-, and carbazol-substituted phthalides (for example, as disclosed in U.S. Pat. Nos. 3,491,111; 3,491,112; 3,491,116; and 3,509,174); nitro-, amino-, amido-, sulfon amido-, aminobenzylidene-, halo-, and anilino-substituted fluorans (for example, as disclosed in U.S. Pat. Nos. 3,624,107; 3,627,787; 3,641,011; 3,642,828; and 3,681,390); spirodipyrans (U.S. Pat. No. 3,971,808); and pyridine and pyrazine compounds (for example, as disclosed in U.S. Pat. Nos. 3,775,424 and 3,853,869). Other specifically eligible chromogenic compounds, not limiting the invention in any way, are: 3-diethylamino-6-methyl-7-anilinofluoran (U.S. Pat. No. 3,681,390); 3-diethylamino-6-methyl-7-(2',4'-dimethylanilino)fluoran (U.S. Pat. No. 4,330,473); 7-(1-ethyl-2-methylindol-3-yl)-7-(4-diethylamino-2-ethoxyphenyl)-5,7-di-hydrofuro[3,4-b]pyridin-5-one (U.S. Pat. No. 4,246,318); 3-diethylamino-7-(2-chloroanilino)fluoran (U.S. Pat. No. 3,920,510); 3-(N-methyl-cyclohexylamino)-6-methyl-7-anilinofluoran (U.S. Pat. No. 3,959,571); 7-(1-octyl-2-methylindol-3-yl)-7-(4-diethylamino-2-ethoxyphenyl)-5,7-di-hydrofuro[3,4-b]pyridin-5-one; 3-diethylamino-7,8-benzofluoran; 3,3-bis(1-ethyl2-methylindol-3-yl)phthalide; 3-diethylamino-7-anilinofluoran; 3-diethylamino-7-benzylaminofluoran; 3'-phenyl-7-dibenzylamino-2,2'-spiro-di[2H-1-benzopyran]; 3-(2-hydroxy-4-diethylaminophenyl)-3-(2,4-dimethoxy-5-anilinophenyl)phthalide; 3-(2-hydroxy-4-diethylaminophenyl)-3-(2,4-dimethoxy-5-(4-chloroanilino)-phenyl)phthalide; and mixtures of any two or more of the above.

The following examples are given to illustrate some of the features of the present invention and should not be considered as limiting. In these examples all parts are by weight, all solutions are in water and all measurements are in the metric system, unless otherwise stated.

The developer materials of the present invention can be made by procedures described in the prior art, for example U.S. Pat. Nos. 2,775,620 and 2,917,550.

In all examples illustrating the present invention a dispersion of a particular system component was prepared by milling the component in an aqueous solution of the binder until a particle size of between about 1 micron and 10 microns was achieved. The milling was accomplished in an attritor, small media mill, or other suitable dispersing device. The desired average particle size was about 1–3 microns in each dispersion.

In these examples separate dispersions comprising the chromogenic compound (Component A), the acidic developer material (Component B), and the sensitizer material (Component C) were prepared.

| Material | Parts |
|---|---|
| Component A | |
| Chromogenic compound | 34.8 |
| Binder, 10% solution of polyvinyl alcohol in water | 50.0 |
| Defoamer and dispersing agents[1] | 0.3 |
| Water | 14.9 |
| Component B | |
| Acidic developer material | 17.0 |
| Binder, 10% solution of polyvinyl alcohol in water | 30.0 |
| Water | 52.9 |
| Defoamer & dispersing agents[1] | 0.1 |
| Component C | |
| Phenyl-1-hydroxy-2-naphthoate | 34.8 |
| Binder, 10% solution of polyvinyl alcohol in water | 50.0 |
| Water | 15.0 |
| Defoamer and dispersing agents[1] | 0.2 |

[1]Equal parts of Nopko NDW and Surfynol 104.
Surfynol 104 is a di-tertiary acetylene glycol surface active agent produced by Air Products and Chemicals Inc.
Nopko NDW is a sulfonated caster oil produced by Nopko Chemical Company.

The chromogenic compounds employed in the examples are listed in Table 1.

TABLE 1

| Chromogenic Compound | Designation of Dispersion Comprising said Chromogenic Compound |
|---|---|
| 3-diethylamino-6-methyl-7-anilinofluoran | A-a |
| 3,3-bis(4-dimethylaminophenyl)-6-dimethylaminophthalide (CVL) | A-b |

TABLE 1-continued

| Chromogenic Compound | Designation of Dispersion Comprising said Chromogenic Compound |
|---|---|
| 7-(1-ethyl-2-methylindol-3-yl)-7-(4-diethylamino-2-ethoxyphenyl)-5,7-dihydrofuro[3,4-b]pyridine-5-one | A-c |

The acidic developer materials employed in the examples are listed in Table 2.

TABLE 2

| Acidic Developer Compound | Designation of Dispersion Comprising said Developer Compound |
|---|---|
| 2,2-bis(4-hydroxyphenyl)propane (Bisphenol A) | B-a |
| 1-phenyl-1,1-bis(4-hydroxyphenyl)butane | B-c |
| 4-phenyl-2,2-bis(4-hydroxyphenyl)butane | B-d |
| 1-phenyl-2,2-bis(4-hydroxyphenyl)butane | B-e |
| 1-phenyl-1,1-bis(4-hydroxyphenyl)ethane | B-f |

In Table 3 are listed various mixtures of Components A, B and C includin the components added, and the wet parts by weight of each. In all cases the following materials were also added to the resulting mixtures:

1. Calcined kaolin clay (designated hereinbelow as "Clay").
2. A 10% solution of polyvinyl alcohol in water (designated hereinbelow as "PVA");
3. Water.
4. A 21% emulsion of zinc stearate (designated hereinbelow as zinc stearate).

Each mixture of Table 3 was applied to paper and dried, yielding a dry coat weight of about 5.2 to about 5.9 gsm.

TABLE 3

| Example | Components | Parts |
|---|---|---|
| Control 1-1 | Dispersion A-a | 0.8 |
| | Dispersion B-a | 9.4 |
| | Zinc stearate | 1.5 |
| | PVA | 2.8 |
| | Clay | 1.2 |
| | Water | 4.3 |
| 2-1 | Dispersion A-a | 0.8 |
| | Dispersion B-c | 9.4 |
| | Zinc stearate | 1.5 |
| | PVA | 2.8 |
| | Clay | 1.2 |
| | Water | 4.3 |
| Control 2 | Dispersion A-a | 0.8 |
| | Dispersion B-a | 7.0 |
| | Dispersion C | 1.1 |
| | Zinc stearate | 1.5 |
| | PVA | 2.9 |
| | Clay | 1.2 |
| | Water | 5.5 |
| 2-2 | Dispersion A-a | 0.8 |
| | Dispersion B-c | 7.0 |
| | Dispersion C | 1.1 |
| | Zinc stearate | 1.5 |
| | PVA | 2.9 |
| | Clay | 1.2 |
| | Water | 5.5 |
| Control 3 | Dispersion A-b | 0.8 |
| | Dispersion B-a | 9.4 |
| | Zinc stearate | 1.5 |
| | PVA | 2.8 |
| | Clay | 1.2 |
| | Water | 4.3 |
| 2-3 | Dispersion A-b | 0.8 |
| | Dispersion B-c | 9.4 |
| | Zinc stearate | 1.5 |
| | PVA | 2.8 |

TABLE 3-continued

| Example | Components | Parts |
|---|---|---|
| | Clay | 1.2 |
| | Water | 4.3 |
| Control 4 | Dispersion A-c | 0.8 |
| | Dispersion B-a | 9.4 |
| | Zinc stearate | 1.5 |
| | PVA | 2.8 |
| | Clay | 1.2 |
| | Water | 4.3 |
| 2-4 | Dispersion A-c | 0.8 |
| | Dispersion B-c | 9.4 |
| | Zinc stearate | 1.5 |
| | PVA | 2.8 |
| | Clay | 1.2 |
| | Water | 4.3 |
| Control 1-2 | Dispersion A-a | 0.8 |
| | Dispersion B-a | 9.4 |
| | Zinc stearate | 1.5 |
| | PVA | 2.8 |
| | Clay | 1.2 |
| | Water | 4.3 |
| 3 | Dispersion A-a | 0.8 |
| | Dispersion B-d | 9.4 |
| | Zinc stearate | 1.5 |
| | PVA | 2.8 |
| | Clay | 1.2 |
| | Water | 4.3 |
| 4 | Dispersion A-a | 0.8 |
| | Dispersion B-e | 9.4 |
| | Zinc stearate | 1.5 |
| | PVA | 2.8 |
| | Clay | 1.2 |
| | Water | 4.3 |
| 5 | Dispersion A-a | 0.8 |
| | Dispersion B-f | 9.4 |
| | Zinc stearate | 1.5 |
| | PVA | 2.8 |
| | Clay | 1.2 |
| | Water | 4.3 |

The thermally-sensitive record material sheets coated with one of the mixtures of Table 3 were imaged by contacting the coated sheet with a metallic imaging block at 300° F. for 5 seconds. The intensity of the image was measured by means of a reflectance reading using a Macbeth reflectance densitometer. A value of about 0.9 or greater usually indicates good image development. The intensities of the images are presented in Table 4.

TABLE 4

Reflectance Intensity of Image Developed at 300° F.

| Example | Intensity |
|---|---|
| Control 1-1 | 1.43 |
| 2-1 | 1.35 |
| Control 2 | 1.44 |
| 2-2 | 1.40 |
| Control 3 | 1.36 |
| 2-3 | 1.15 |
| Control 4 | 1.32 |
| 2-4 | 0.96 |
| Control 1-2 | 1.35 |
| 3 | 1.13 |
| 4 | 1.33 |
| 5 | 1.34 |

The background coloration of the examples was measured by means of a reflectance reading using a Bausch & Lomb Opacimeter. The higher the value the less background coloration. The background data are entered in Table 5.

TABLE 5

| Example | Background Intensity |
|---|---|
| Control 1-1 | 81.2 |

TABLE 5-continued

| Example | Background Intensity |
|---|---|
| 2-1 | 89.1 |
| Control 2 | 82.1 |
| 2-2 | 88.2 |
| Control 3 | 76.4 |
| 2-3 | 86.1 |
| Control 4 | 72.5 |
| 2-4 | 88.2 |
| Control 1-2 | 79.6 |
| 3 | 87.6 |
| 4 | 83.7 |
| 5 | 86.3 |

From the data of Tables 4 and 5 it is readily apparent that thermally-responsive recording materials comprising the developer materials of the present invention produce acceptable image intensities and greatly improved background coloration compared to corresponding thermally-responsive recording material comprising previously known developer material.

The invention being thus described, it will be obvious that the same may be varied in many ways. Such variations are not to be regarded as a departure from the spirit and scope of the invention and all such modifications are intended to be included within the scope of the following claims.

What is claimed is:

1. A thermally-responsive record material comprising a support member bearing a thermally-sensitive color-forming composition comprising chromogenic material and a bisphenol compound of the structure

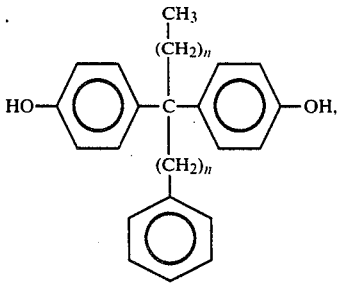

wherein n is 0, 1 or 2, which produces a change in color of said chromogenic material by reacting with the chromogenic material when heated.

2. The record material of claim 1 in which the bisphenol is selected from the group consisting of 1-phenyl-1,1-bis(4-hydroxyphenyl)butane; 4-phenyl-2,2-bis(4-hydroxyphenyl)butane; 1-phenyl-2,2-bis(4-hydroxyphenyl)butane; and 1-phenyl-1,1-bis(4-hydroxyphenyl)ethane.

3. The record material of claim 1 in which the chromogenic material is selected from the group consisting of 3-diethylamino-6-methyl-7-anilinofluoran; 7-(1-ethyl-2-methylindol-3-yl)-7-(4-diethylamino-2-ethoxyphenyl)-5,7-dihydrofuro[3,4-b]pyridin-5-one; 3-diethylamino-7-(2-chloroanilino)fluoran; 3-(N-methylcyclohexylamino)-6-methyl-7-anilinofluoran; 7-(1-octyl-2-methylindol-3-yl)-7-(4-diethylamino-2-ethoxyphenyl)-5,7-dihydrofuro[3,4-b]pyridin-5-one; 3'-phenyl-7-dibenzylamino-2,2'-spiro-di-[2H-1-benzopyran]; 3,3-bis(4-dimethylaminophenyl)-6-dimethylaminophthalide; 3-(2-hydroxy-4-diethylaminophenyl)-3-(2,4-dimethoxy-5-anilinophenyl)phthalide; 3-(2-hydroxy-4-diethylaminophenyl)-3-(2,4-dimethoxy-5-(4-chloroanilino)phthalide; and mixtures thereof.

4. The record material of claim 3 in which the chromogenic material is selected from the group consisting of 3-diethylamino-6-methyl-7-anilinofluoran; 3,3-bis(4-dimethylaminophenyl)-6-dimethylaminophthalide; and 7-(1-ethyl-2-methylindol-3-yl)-7-(4-diethylamino-2-ethoxyphenyl)-5,7-dihydrofuro[3,4-b]pyridine-5-one.

5. The record material of claim 4 in which the chromogenic material is 3-diethylamino-6-methyl-7-anilinofluroan.

6. The record material of claim 1 or 4 which further comprises a binder selected from the group consisting of polyvinyl alcohol, methylcellulose, hydroxypropylmethylcellulose, starch, hydroxyethylcellulose, styrene-butadiene latex and mixtures thereof.

7. The record material of claim 6 in which the binder is selected from the group consisting of polyvinyl alcohol, methylcellulose, styrene-butadiene latex and mixtures thereof.

8. The record material of claim 7 in which the binder is a mixture of polyvinyl alcohol, methylcellulose and styrene-butadiene latex.

9. A thermally-responsive record material comprising a support member bearing a thermally-sensitive color-forming composition comprising chromogenic material and a color developer material selected from the group consisting of 1-phenyl-1,1-bis(4-hydroxyphenyl)butane; 4-phenyl-2,2-bis(4-hydroxyphenyl)butane; 1-phenyl-2,2-bis(4-hydroxyphenyl)butane; 1-phenyl-1,1-bis(4-hydroxyphenyl)ethane; and mixtures thereof wherein a change in color of said chromogenic material is produced by reaction with said color developer when heated.

10. The record material of claim 9 in which the chromogenic material is selected from the group consisting of 3-diethylamino-6-methyl-7-anilinofluoran; 7-(1-ethyl-2-methylindol-3-yl)-7-(4-diethylamino-2-ethoxyphenyl)-5,7-dihydrofuro[3,4-b]pyridin-5-one; 3-diethylamino-7-(2-chloroanilino)fluoran; 3-(N-methylcyclohexylamino)-6-methyl-7-anilinofluoran; 7-(1-octyl-2-methylindol-3-yl)-7-(4-diethylamino-2-ethoxyphenyl)-5,7-dihydrofuro[3,4-b]pyridin-5-one; 3'-phenyl-7-dibenzylamino-2,2'-spiro-di-[2H-1-benzopyran]; 3,3-bis(4-dimethylaminophenyl)-6-dimethylaminophthalide; 3-(2-hydroxy-4-diethylaminophenyl)-3-(2,4-dimethoxy-5-anilinophenyl)phthalide; 3-(2-hydroxy-4-diethylaminophenyl)-3-(2,4-dimethoxy-5-(4-chloroanilino)-phenyl)phthalide; and mixtures thereof.

11. The record material of claim 10 in which the chromogenic material is 3-diethylamino-6-methyl-7-anilinofluoran, 3,3-bis(4-dimethylaminophenyl)-6-dimethylaminophthalide or 7-(1-ethyl-2-methylindol-3-yl)-7-(4-diethylamino-2-ethoxyphenyl)-5,7-dihydrofuro[3,4-b]pyridine-5-one.

12. The record material of claim 11 in which the chromogenic materal is 3-diethylamino-6-methyl-7-anilinofluroan.

13. The record material of claim 9 or 11 which further comprises a binder selected from the group consisting of polyvinyl alcohol, methylcellulose, hydroxypropylmethylcellulose, starch, hydroxyethylcellulose, styrene-butadiene latex and mixtures thereof.

14. The record material of claim 13 in which the binder is selected from the group consisting of polyvinyl alcohol, methylcellulose, styrene-butadiene latex and mixtures thereof.

15. The record material sheet of claim 14 in which the binder is a mixture of polyvinyl alcohol, methylcellulose and styrene-butadiene latex.

* * * * *

UNITED STATES PATENT AND TRADEMARK OFFICE

CERTIFICATE OF CORRECTION

PATENT NO. : 4,675,707

DATED : June 23, 1987

INVENTOR(S) : Vervacke et al.

It is certified that error appears in the above-identified patent and that said Letters Patent are hereby corrected as shown below:

In claim 3, the next to the last line of said claim, the portion of the formula reading "-5-(4-chloroanilino)phthalide" should read -- -5-(4-chloroanilino)phenyl)phthalide --.

Signed and Sealed this

Fifth Day of January, 1988

*Attest:*

DONALD J. QUIGG

*Attesting Officer*

*Commissioner of Patents and Trademarks*